US009917391B2

(12) United States Patent
Zhang

(10) Patent No.: US 9,917,391 B2
(45) Date of Patent: Mar. 13, 2018

(54) ELECTRICAL CONNECTOR HAVING WIDENED AND ADDED POWER TERMINALS

(71) Applicant: FOXCONN INTERCONNECT TECHNOLOGY LIMITED, Grand Cayman (KY)

(72) Inventor: Yao Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/611,809

(22) Filed: Jun. 2, 2017

(65) Prior Publication Data

US 2017/0352973 A1 Dec. 7, 2017

(30) Foreign Application Priority Data

Jun. 2, 2016 (CN) ..... 2016 1 0382376

(51) Int. Cl.
*H01R 13/648* (2006.01)
*H01R 13/40* (2006.01)
(Continued)

(52) U.S. Cl.
CPC ..... *H01R 13/40* (2013.01); *H01R 13/04* (2013.01); *H01R 24/60* (2013.01); *H01R 2107/00* (2013.01)

(58) Field of Classification Search
CPC ..... H01R 23/7073; H01R 23/688; H01R 23/6873; H01R 13/658; H01R 13/65802
(Continued)

(56) References Cited

U.S. PATENT DOCUMENTS 6,945,796 B2 * 9/2005 Bassler ..... H01R 12/724 439/101
6,969,268 B2 * 11/2005 Brunker ..... H01R 23/688 439/108
(Continued)

FOREIGN PATENT DOCUMENTS

CN 203813082 U 9/2014
CN 203859265 U 10/2014
(Continued)

*Primary Examiner* — Hien Vu
(74) *Attorney, Agent, or Firm* — Wei Te Chung; Ming Chieh Chang

(57) ABSTRACT

An electrical connector includes an insulative housing and two rows of terminals reversely-symmetrically arranged in the insulative housing, each terminal having a contacting portion, a securing portion, and a tail portion, each row of terminals comprising a first and a second grounding terminals and a first and a second power terminals, each row of terminals lacking two terminals to thereby form a first vacant space between the first grounding terminal and the first power terminal and lacking another two terminals to thereby form a second vacant space between the second grounding terminal and the second power terminal. For each row of terminals, the width of the securing portion of each of the first grounding terminal, the second grounding terminal, and the first power terminal is greater than that of each of the remaining terminals. Each row of terminals include a third power terminal disposed in the second vacant space.

13 Claims, 8 Drawing Sheets

(51) Int. Cl.
*H01R 24/60* (2011.01)
*H01R 13/04* (2006.01)
*H01R 107/00* (2006.01)

(58) Field of Classification Search
USPC ..... 439/660, 108, 607.4, 79
See application file for complete search history.

(56) References Cited

U.S. PATENT DOCUMENTS

| | | | | |
|---|---|---|---|---|
| 7,611,387 | B1 * | 11/2009 | Zhang | H01R 12/725 439/660 |
| 8,702,452 | B2 | 4/2014 | Tai et al. | |
| 8,899,996 | B2 * | 12/2014 | Lim | H01R 12/724 439/607.05 |
| 9,478,905 | B2 | 10/2016 | Golko et al. | |
| 2013/0196550 | A1 | 8/2013 | Casher et al. | |
| 2015/0340791 | A1 | 11/2015 | Kao et al. | |
| 2016/0294108 | A1 | 10/2016 | Tsai et al. | |
| 2016/0372870 | A1 | 12/2016 | Guo | |
| 2017/0018883 | A1 | 1/2017 | Chen et al. | |

FOREIGN PATENT DOCUMENTS

| | | | |
|---|---|---|---|
| CN | 105024197 | U | 11/2015 |
| CN | 204809520 | U | 11/2015 |
| CN | 105375143 | A | 3/2016 |
| TW | M499669 | U | 4/2015 |

* cited by examiner

| A1 | A2 | A3 | A4 | A5 | A6 | A7 | A8 | A9 | A10 | A11 | A12 |
|---|---|---|---|---|---|---|---|---|---|---|---|
| GND | | Vbus | Vbus | CC1 | D+ | D− | SBU1 | Vbus | | | GND |
| | | | | | | | | | | | |
| GND | | | Vbus | SBU2 | D− | D+ | CC2 | Vbus | Vbus | | GND |
| B12 | B11 | B10 | B9 | B8 | B7 | B6 | B5 | B4 | B3 | B2 | B1 |

FIG. 6

ELECTRICAL CONNECTOR HAVING WIDENED AND ADDED POWER TERMINALS

BACKGROUND OF THE INVENTION

1. Field of the Invention

The present invention relates to a dual orientation electrical connector having plural power terminals for conducting large current.

2. Description of Related Arts

U.S. Pat. No. 9,478,905, issued on Oct. 25, 2016, discloses a dual orientation connector, including two separate sets of contacts arranged at top and bottom surfaces of housing. In some embodiments designed for specific functions, certain contacts are omitted from the connector, i.e., forming vacant spaces. For example, the connector may include four contacts, two contacts on an upper surface of a tab portion thereof and two contacts on a lower surface thereof. The four contacts provide left and right audio as well as microphone power, and are sized and spaced to match the locations, size, and spacing of predetermined contacts. Similarly, U.S. Patent Application Publication No. 2016/0372870 discloses two rows of terminals reversely-symmetrically arranged in an insulative housing. Each row of terminals are in lack of at least two terminals to thereby form a vacant space between a grounding terminal and a power terminal.

U.S. Patent Application Publication No. 2017/0018883 discloses a dual orientation connector where a rightmost or leftmost ground terminal (Gnd) or a first supplemental terminal (SUB1) can be omitted. Furthermore, the ground terminal (Gnd) may be replaced by a power terminal (Power/VBUS) where a width of the power terminal (Power/VBUS) may be equal to a width of a first signal contact, or greater than the width of the first signal contact for large current transmission.

SUMMARY OF THE INVENTION

An electrical connector comprising: an insulative housing; and two rows of terminals reversely-symmetrically arranged in the insulative housing, each terminal having a contacting portion, a securing portion, and a tail portion, each row of terminals comprising a first and a second grounding terminals and a first and a second power terminals, each row of terminals lacking two terminals to thereby form a first vacant space between the first grounding terminal and the first power terminal and lacking another two terminals to thereby form a second vacant space between the second grounding terminal and the second power terminal; wherein for each row of terminals, a width of the securing portion of each of the first grounding terminal, the second grounding terminal, and the first power terminal is greater than a respective width of the contacting portion and of the tail thereof; for each row of terminals, the width of the securing portion of each of the first grounding terminal, the second grounding terminal, and the first power terminal is greater than that of each of the remaining terminals; and each row of terminals further comprise a third power terminal disposed in the second vacant space.

BRIEF DESCRIPTION OF THE DRAWING

FIG. 6 is a schematic table showing terminal arrangement of the receptacle electrical connector which is adapted to be mated with the subject electrical connecctor.

DETAILED DESCRIPTION OF THE PREFERRED EMBODIMENT

Figure 1:
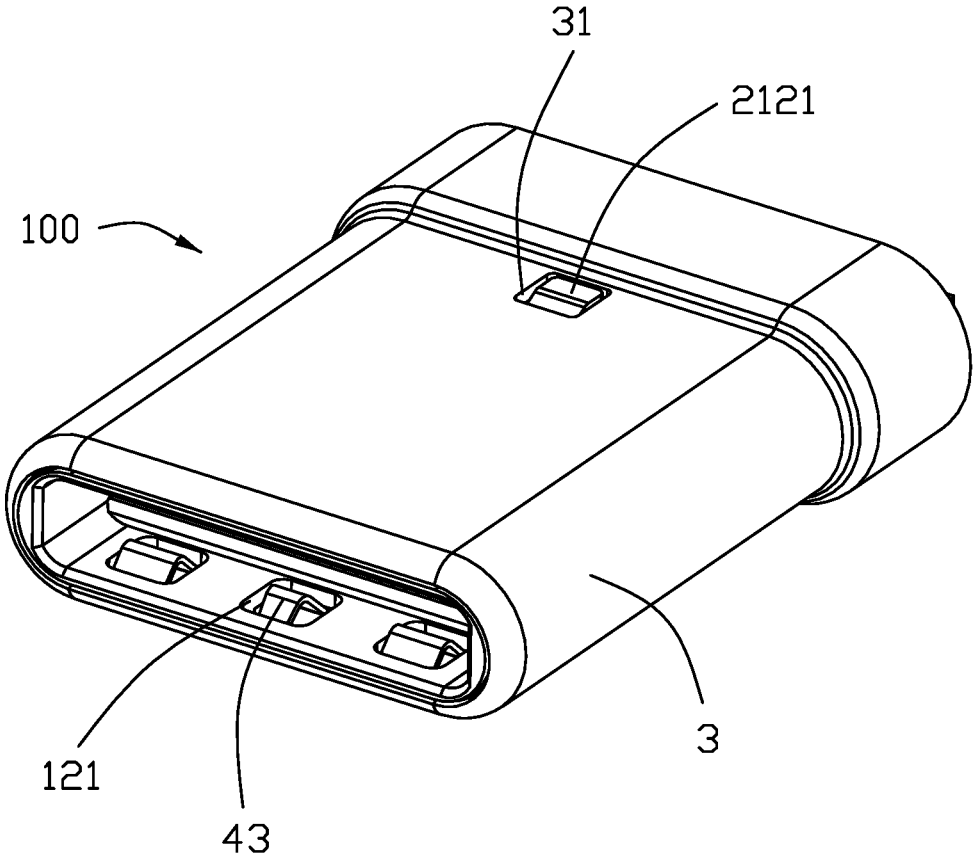
FIG. 1 is a perspective view of an electrical connector in accordance with the present invention.
Figure 2:
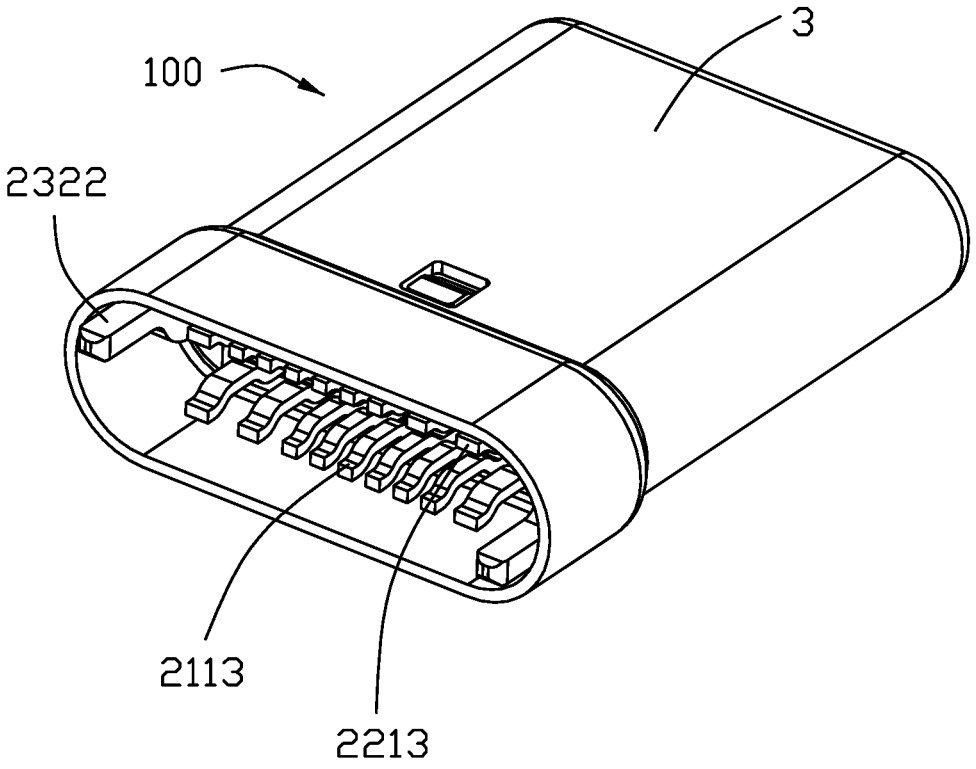
FIG. 2 is another perspective view of the electrical connector.

Referring to FIGS. 1 to 6, an electrical connector 100 comprises an insulative housing 1 and two rows of terminals 211 and 221 arranged in the insulative housing. The terminals are reversely-symmetrically arranged so that the connector 100 embodies a dual orientation electrical connector. The terminals may alternatively be constructed as a terminal module 2. The electrical connector 100 may further comprise a shielding shell 3 enclosing the housing 1 and a pair of grounding pieces 4 arranged on the housing 1 and in contact with the shell 3.

Figure 3:
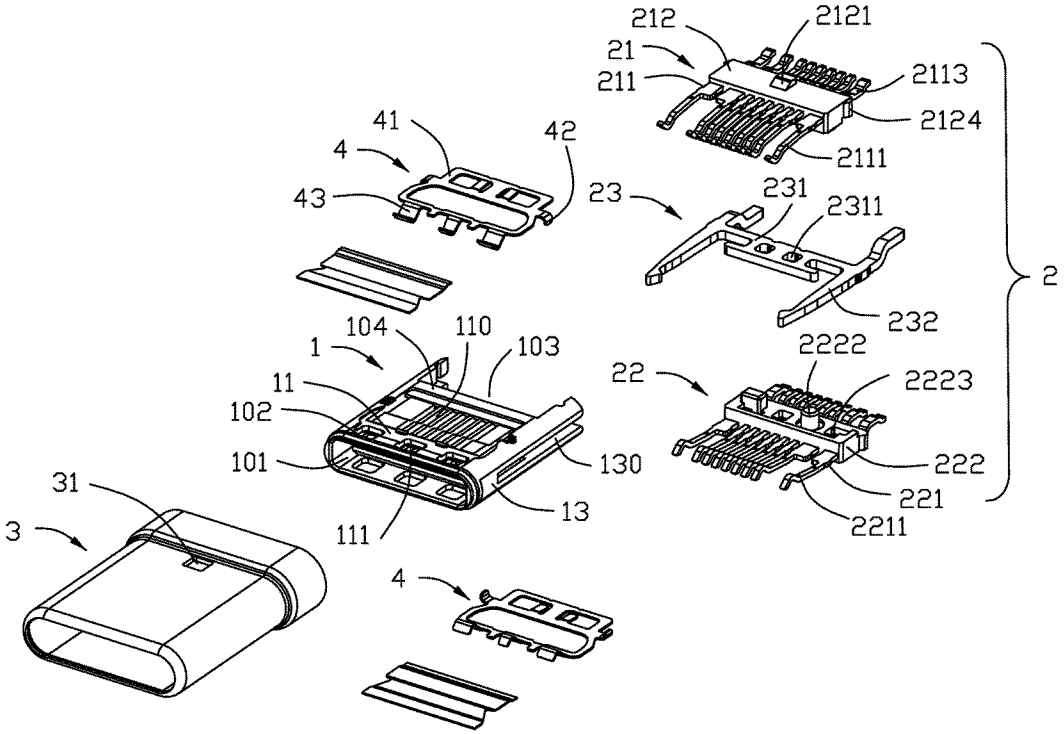
FIG. 3 is an exploded view of the electrical connector.
Figure 4:
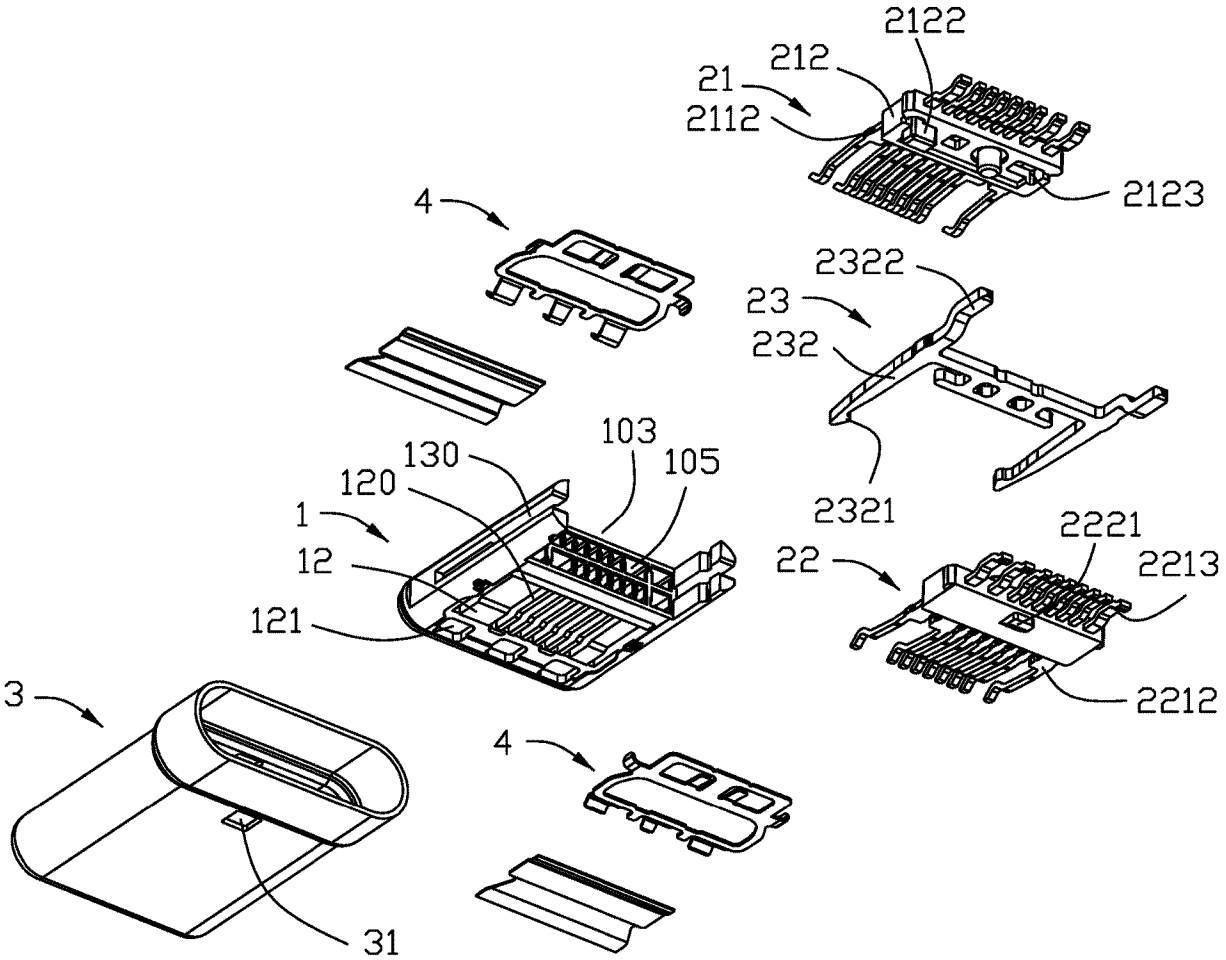
FIG. 4 is another exploded view of the electrical connector.

Referring to FIGS. 3 and 4, the housing 1 is substantially tubular and includes a top wall 11, a bottom wall 12, and two side walls 13, which together surround an insertion cavity 10. The housing 1 further includes a front portion 102 having a front opening 101 and a rear portion 104 having a rear opening 103. The top wall 11 has first through holes 110 and the bottom wall 12 has second through holes 120. The side wall 13 has a slot 130. The top and bottom wall 11 and 12 have plural holes 111 and 121, respectively, corresponding to the two grounding pieces 4. The two side walls 13 extend rearwardly along a mating direction beyond the top and bottom wall 11 and 12. Two rows of grooves 105 are formed at a rear of the housing 1.

In the embodiment shown, the terminal module 2 is mounted to the housing 1 and includes an upper terminal unit 21, a lower terminal unit 22, and a metal latch 23 between the upper and lower terminal units 21 and 22. The upper terminal unit 21 includes plural conductive terminals 211 and an insulating base 212. The conductive terminal 211 has a contacting portion 2111 for extending into the insertion cavity 10, a securing portion 2112 fixed in the insulating base 212, and a tail portion 2113 extending rearwardly from the insulating base 212. The contacting portion 2111 is adapted for electrical connection with a complementary connector while the tail portion 2113 may be adapted for electrical connection with an internal printed circuit board. The insulating base 212 has a protrusion 2121 at an upper surface thereof, plural posts 2122 and holes 2123 at a lower surface thereof, and respective positioning portions 2124 at two side surfaces thereof.

Similarly, the lower terminal unit 22 includes plural conductive terminals 221 and an insulating base 222. The conductive terminal 221 has a contacting portion 2211 for extending into the insertion cavity 10, a securing portion 2212 fixed in the insulating base 222, and a tail portion 2213 extending rearwardly from the insulating base 222. The contacting portion 2211 is adapted for electrical connection with a complementary connector while the tail portion 2113 may be adapted for electrical connection with an internal printed circuit board which in turn connects to a cable. The insulating base 222 has a protrusion 2221 at an upper surface thereof, plural posts 2222 and holes 2223 at a lower surface thereof, and respective positioning portions 2224 at two side surfaces thereof. The contacting portions 2211 of the lower conductive terminals 221 are aligned with the contacting portions 2111 of the upper conductive terminals 211.

Figure 5:
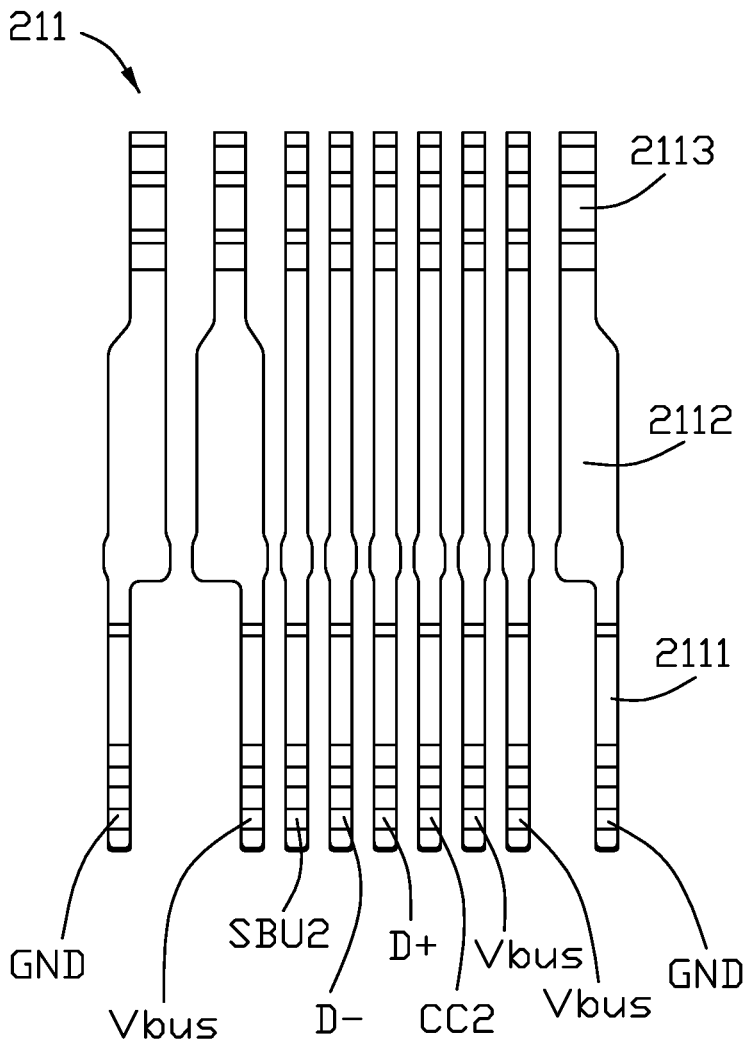
FIG. 5 is a view showing one row of terminals of the electrical connector.

Referring to FIGS. 5 and 6, there are nine upper conductive terminals 211 and nine lower conductive terminals 221. As seen in FIG. 6, in the upper row from left to right in sequence, are one grounding terminal (GND), two power terminals (Vbus), one detection terminal (CC1), one positive signal terminal (D+), one negative signal terminal (D−), one supplement terminal (SBU1), one power terminal (Vbus), and one grounding terminal (GND) in first, third, fourth, fifth, sixth, seventh, eighth, ninth, and twelfth terminal positions out of a total of twelve terminal positions. As seen in FIG. 5, the upper row of terminals 211 include a first leftmost grounding terminal GND, a second rightmost grounding terminal GND, a first power terminal Vbus adjacent to the first leftmost grounding terminal GND, a second power terminal Vbus adjacent to the second rightmost grounding terminal GND, and a third power terminal Vbus adjacent to the second power terminal Vbus. In effect, the upper row of terminals 211 lack two terminals to thereby form a first vacant space between the first leftmost grounding terminal GND and the adjacent first power terminal Vbus and lack another two terminals to thereby form a second vacant space between the second rightmost grounding terminal GND and the third power terminal Vbus, while the second power terminal fills up the second vacant space (i.e., is disposed between the second rightmost grounding terminal GND and the third power terminal Vbus). This is significant because the terminal position originally for a signal terminal is filled up by a power terminal which increases not only current flow but also heat dissipation, beneficial for quick charging. To meet requirement of large current flow, a width of the securing portion 2112 of each of the first grounding terminal GND, the second grounding terminal GND, and the first power terminal Vbus is widened to be greater than a respective width of the contacting portion 2111 and of the tail 2113. Moreover, the width of the securing portion 2112 of each of the first grounding terminal GND, the second grounding terminal GND, and the first power terminal Vbus is greater than that of each of the other terminals. As can be understood, a width of the securing portion 2111 of the second power terminal Vbus remains equal to a width of the securing portion of the third power terminal. Instead of widening the third power terminal Vbus, an additional power terminal is provided between the vacant space (i.e., between the second rightmost grounding terminal GND and the third power terminal Vbus). The lower row of terminals 221 are similarly arranged, i.e., reversely-symmetrically as described above in terms of a dual orientation connector.

The metal latch 23 has a supporting portion 231 and a pair of latching arms 232 on two sides of the supporting portion 231. The latching arms 232 are to be received in the slots 130. Slots or holes 2311 are disposed on the supporting portion 231 for cooperating with the posts and holes of the insulating bases 212 and 222. The latching arm 232 has front hook 2321 and rear leg 2322.

The shielding shell 3 has a respective opening 31 on an upper and lower surfaces thereof for engaging the protrusion 2121 or 2221.

The pair of grounding pieces 4 are respectively mounted to the top bottom walls 11 and 12. The grounding piece 4 has a frame 41, a pair of mounting portions 42, and plural spring fingers 43 extending forwardly into the insertion cavity 10 through the top or bottom wall holes 111 or 121.

Figure 5A:
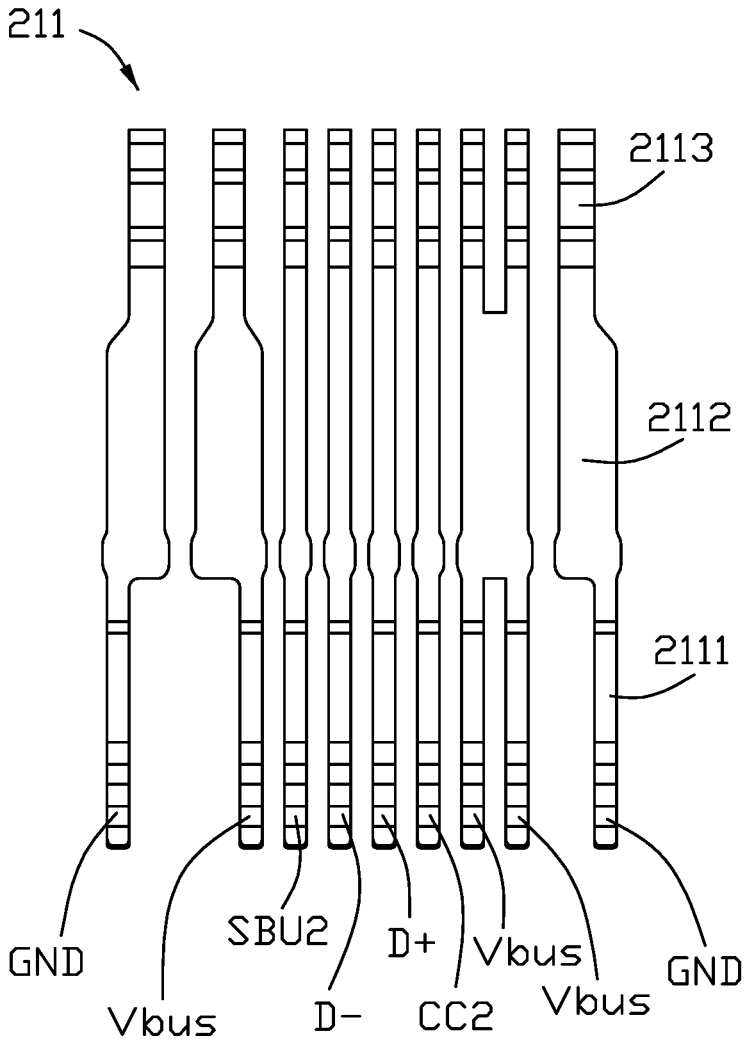
FIG. 5(A) is a view showing one row of terminals of the electrical connector according to another embodiment.
Figure 5B:
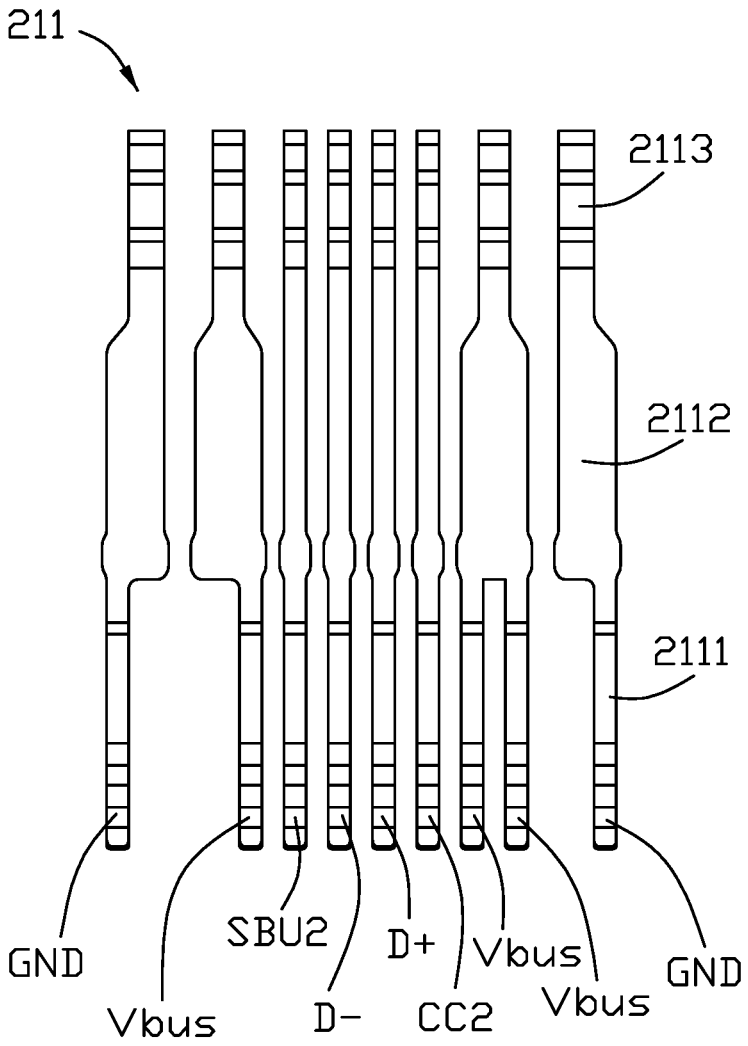
FIG. 5(B) is a view showing one row of terminals of the electrical connector according to another embodiment.

FIG. 5(A) shows another embodiment wherein the additional power terminal Vbus and the original power terminal Vbus are unified together at the main body or middle/securing portion. FIG. 5(B) shows a further embodiment wherein the two respective tail portions of the unified power terminals as shown in FIG. 5(A) are further unified together as that of another power terminal Vbus on the other side. Notably, alternately one of the two tail portions of the unified power terminals Vbus may be removed rather than being joined together.

In brief, one feature of the invention is to provide twelve terminal positions with equal intervals along the transverse direction wherein the first position and the twelve position are occupied by the grounding terminal GND, the fourth position and the ninth position are occupied by the power terminal Vbus, the sixth position and the seven positions are occupied by the USB 2.0 positive signal terminal D+ and the USB 2.0 negative terminal D−, the fifth position and the eighth position are occupied by either the detection terminal CC or supplement terminal SBU. In other words, in the original design, the inner region between the two power terminals Vbus at the fourth position and the ninth position are fully occupied by the corresponding terminals while the two outer regions, i.e., the first vacant space and the second vacant space, which are respectively located between the two power terminals Vbus and the corresponding grounding terminals GND, are vacant. The invention is to put an additional power terminal Vbus adjacent to the corresponding power terminal Vbus in at least one of the first vacant space and the second vacant space wherein the contacting portion of the additional power terminal Vbus is discrete from that of the neighboring power terminal Vbus while the securing portion and/or the tail portion of the additional power terminal Vbus may be optionally unified/joined with that of the neighboring power terminal Vbus. In this situation, the additional power terminal Vbus is still spaced from the corresponding grounding terminal GND with one terminal position therebetween in the transverse direction. Another feature of the invention is the securing portion of the power terminal Vbus and that of the corresponding grounding terminal GND are transversely widened so as to approach each other in the transverse direction even though the contacting portion of the power terminal Vbus and that of the corresponding grounding still exposed upon the insertion cavity 10, keep the same distance therebetween in the transverse direction. Another feature of the invention is to have the tail portions of both the power terminal Vbus and the grounding terminal GND are widened in the transverse direction. Another feature of the invention is to have the original power terminal Vbus, which has a widened securing portion 2112 occupying both the ninth and tenth positions while the tail portion is located between the ninth position and the tenth position in the transverse direction. Another feature of the invention is to have the widened tail portion of the power terminal not aligned with the corresponding contacting portion in the front-to-back direction, and similarly have the widened tail portion of the grounding terminal not aligned with the corresponding contacting portion in the front-to-back direction.

What is claimed is:

1. An electrical connector comprising:

an insulative housing;

two rows of terminals and a metal latch having latch arms in between the two rows of the terminals, the two rows of the terminals reversely-symmetrically arranged in the insulative housing, each terminal having a contacting portion, a securing portion, and a tail portion, each row of terminals comprising a first and a second grounding terminals and a first and a second power terminals, each row of terminals lacking two terminals to thereby form a first vacant space between the first grounding terminal and the first power terminal and lacking another two terminals to thereby form a second vacant space between the second grounding terminal and the second power terminal;

wherein for each row of terminals, a width of the securing portion of each of the first grounding terminal, the second grounding terminal, and the first power terminal is greater than a respective width of the contacting portion and of the tail thereof;

for each row of terminals, the width of the securing portion of each of the first grounding terminal, the second grounding terminal, and the first power terminal is greater than that of each of the remaining terminals; and each row of terminals further comprise a third power terminal disposed in the second vacant space;

wherein the insulative housing has an insertion cavity, the insertion cavity defining twelve terminal positions at two opposite sides thereof; and the first and second grounding terminals are respectively arranged at the first and twelfth terminal positions, and the first and second power terminals are respectively arranged at the fourth and ninth terminal positions; and wherein the tail portion of said at least one of the grounding terminals is not aligned with the contacting portion thereof in the front-to-back direction, and the tail portion of said corresponding power terminal sharing the same outer region is not aligned with the corresponding contacting portion thereof in the front-to-back direction.

2. The electrical connector as claimed in claim 1, wherein a width of the securing portion of the third power terminal is equal to a width of the securing portion the second power terminal.

3. An electrical connector comprising:

an insulative housing having a metal latch with latch arms thereon and twelve terminal positions in a row with equal intervals along a transverse direction, said twelve terminal positions being named in sequence a first position, a second position, a third position, a fourth position, a fifth position, a sixth position, a seven position, an eighth position, a ninth position, a tenth position, an eleventh position and a twelfth position, a plurality of terminals in the row disposed within the corresponding terminal positions, respectively, and including power terminals, grounding terminals and other terminals, each of said terminals including a contacting portion, a tail portion and a securing portion therebetween in a front-to-back direction perpendicular to said transverse direction;

said first position and said twelve position being occupied respectively by two of said grounding terminals, said fourth position and said ninth positions being occupied by two of said power terminals, an inner region defined between the two power terminals being equipped with corresponding other terminals fully occupying the corresponding fifth, sixth, seven and eighth positions while two outer regions respectively located by two sides of the inner region and between the two power terminals and the corresponding grounding terminals are not fully equipped with the corresponding terminals but with some vacancies therein;

wherein one additional power terminal is loaded in one of said two outer regions and adjacent to the corresponding power terminal; wherein the contacting portion of the additional power terminal and that of the corresponding neighboring power terminals are discrete from each other;

wherein the securing portion of at least one of the grounding terminals and that of the corresponding power terminal sharing the same outer region are widened and approach to each other in the transverse direction while the contacting portions thereof keep same;

wherein the tail portion of said at least one of the grounding terminals and that of the corresponding power terminal sharing the same outer region are widened and approach to each other in the transverse direction; and wherein the tail portion of said at least one of the grounding terminals is not aligned with the contacting portion thereof in the front-to-back direction, and the tail portion of at least one of said power terminal sharing the same outer region is not aligned with the corresponding contacting portion thereof in the front-to-back direction.

4. The electrical connector as claimed in claim 3, wherein the securing portion of at least one grounding terminals is widened in the transverse direction.

5. The electrical connector as claimed in claim 3, wherein the securing portion of at least one power terminals is widened in the transverse direction.

6. The electrical connector as claimed in claim 3, wherein said additional power terminal is spaced, with one terminal position, from the corresponding grounding terminal sharing the same outer region.

7. The electrical connector as claimed in claim 6, wherein the securing portion of said corresponding grounding terminal sharing the same outer region, is widened in the transverse direction.

8. The electrical connector as claimed in claim 7, wherein the tail portion of said corresponding grounding terminal sharing the same outer region, is widened in the transverse direction.

9. The electrical connector as claimed in claim 8, wherein said widened tail portion is not aligned with the corresponding contacting portion in the front-to-back direction.

10. The electrical connector as claimed in claim 3, wherein the securing portion of the additional power terminal and that of the neighboring power terminal are unified together in the transverse direction.

11. The electrical connector as claimed in claim 10, wherein the tail portion of the additional power terminal and that of the neighboring power terminal are unified together in the transverse direction.

12. The electrical connector as claimed in claim 11, wherein said unified tail portion is widened and is not aligned with the contacting portion of either the addition power terminal or that of the neighboring power terminal.

13. An electrical connector comprising:

an insulative housing having a metal latch with latch arms thereon and twelve terminal positions in a row with equal intervals along a transverse direction, said twelve terminal positions being named in sequence a first position, a second position, a third position, a fourth position, a fifth position, a sixth position, a seven position, an eighth position, a ninth position, a tenth position, an eleventh position and a twelfth position, a plurality of terminals in the row disposed within the corresponding terminal positions, respectively, and including power terminals, grounding terminals and other terminals, each of said terminals including a contacting portion, a tail portion and a securing portion therebetween in a front-to-back direction perpendicular to said transverse direction;

said first position and said twelve position being occupied respectively by two of said grounding terminals, said fourth position and said ninth positions being occupied by two of said power terminals, an inner region defined between the two power terminals being equipped with corresponding other terminals fully occupying the corresponding fifth, sixth, seven and eighth positions while two outer regions respectively located by two sides of the inner region and between the two power terminals and the corresponding grounding terminals are not fully equipped with the corresponding terminals but with some vacancies therein;

wherein one of said power terminals and the corresponding grounding terminal sharing the same outer region without any terminals therebetween both have the widened securing portions approaching each other in the transverse direction while the corresponding contacting portions keep same;

wherein the tail portion of said one of the power terminals and the corresponding grounding terminal are widened and approaching each other in the transverse direction;

wherein said widened tail portion of the one of the power terminals is not aligned with corresponding contacting portion in the front-to-back direction; and wherein said widened tail portion of the corresponding grounding terminal is not aligned with the corresponding contacting portion in the front-to-back direction.

* * * * *